United States Patent [19]

Hobbs

[11] 3,931,958

[45] Jan. 13, 1976

[54] LOAD MOVING APPARATUS

[75] Inventor: Howard Frederick Hobbs, Napton-on-the-Hill, near Rugby, England

[73] Assignee: Variable Kinetic Drives, Ltd., England

[22] Filed: June 18, 1974

[21] Appl. No.: 480,428

[30] Foreign Application Priority Data

July 3, 1973 United Kingdom ..... 31668/73

[52] U.S. Cl. ..... 254/150 R; 74/805

[51] Int. Cl.[2] ..... B66D 1/30

[58] Field of Search ..... 254/175.5, 175.7, 186 R, 254/150 R, 149; 74/751 R, 793, 796, 394, 804 R, 805, 10.52, 836, 123; 242/46.5

[56] References Cited

UNITED STATES PATENTS

| | | | |
|---|---|---|---|
| 3,043,164 | 7/1962 | Sundt | 74/804 |
| 3,074,294 | 1/1963 | Woolley | 74/793 |
| 3,420,113 | 1/1969 | Tauscher | 74/793 |
| 3,508,451 | 4/1970 | Yoshida et al. | 74/793 |

*Primary Examiner*—Robert J. Spar
*Assistant Examiner*—Kenneth Noland
*Attorney, Agent, or Firm*—Dowell & Dowell

[57] ABSTRACT

The invention provides a load moving device, especially a ship's winch in which the driving ratio is varied infinitely in accordance with the varying load, the device including a pair of eccentrics one surrounding the other to provide a combined variable throw, these eccentrics being normally held against a spring in maximum throw relative positions, and means (e.g. spring urged rollers) being provided to restrain the outer eccentric to a degree depending on the load so as to cause relative rotation of the eccentrics thereby varying the driving ratio.

6 Claims, 4 Drawing Figures

LOAD MOVING APPARATUS

This invention relates to load moving devices and is more particularly but not solely concerned with hand operated winches for hauling in sheets and trimming sails in sailing boats.

In operation, the loads on these winches vary widely and it is desirable to wind in the sheet under light load as quickly as possible and with increasing load, and accordingly an increasing power ratio between a handle and the winch drum is required so that there can be a very large power ratio for final trimming under heavy load. Winches now in use employ up to three gear ratios which can be selected but this is not completely satisfactory or convenient for rapid and easy operation.

The object of the present invention is to provide an infinitely variable ratio between the handle or other input member and the drum or other load carrying member.

According to the invention a hand operated winch or other load carrying device comprises an input member, an output member, an inner eccentric an outer eccentric surrounding the inner eccentric so that the two eccentrics combine to form a variable throw device, spring means pretensioned to hold the eccentrics in about maximum throw position, both said eccentrics being drivably connected with the input member, the outer of said eccentrics being connected to the input member by said spring means, and restraining means to apply varying degree of restraint to the rotation of the outer eccentric with correspondingly varying load on the output member thereby causing relative rotation of the eccentrics to vary their combined throw and vary the driving ratio.

The eccentrics may be so arranged that maximum throw is obtained in the no-load position and zero throw if the outer eccentric is rotated 180° on the inner eccentric.

Rotation of the outer eccentric on the inner eccentric will wind or unwind the torsion spring.

The torsion spring will wind according to the load on the winch handle and input shaft thereby varying the throw.

The torsion spring may also wind and unwind during operation to smooth out the driving impulses from the one way clutches.

One form of the invention is illustrated by way of example in the accompanying drawings wherein.

Figure 1:
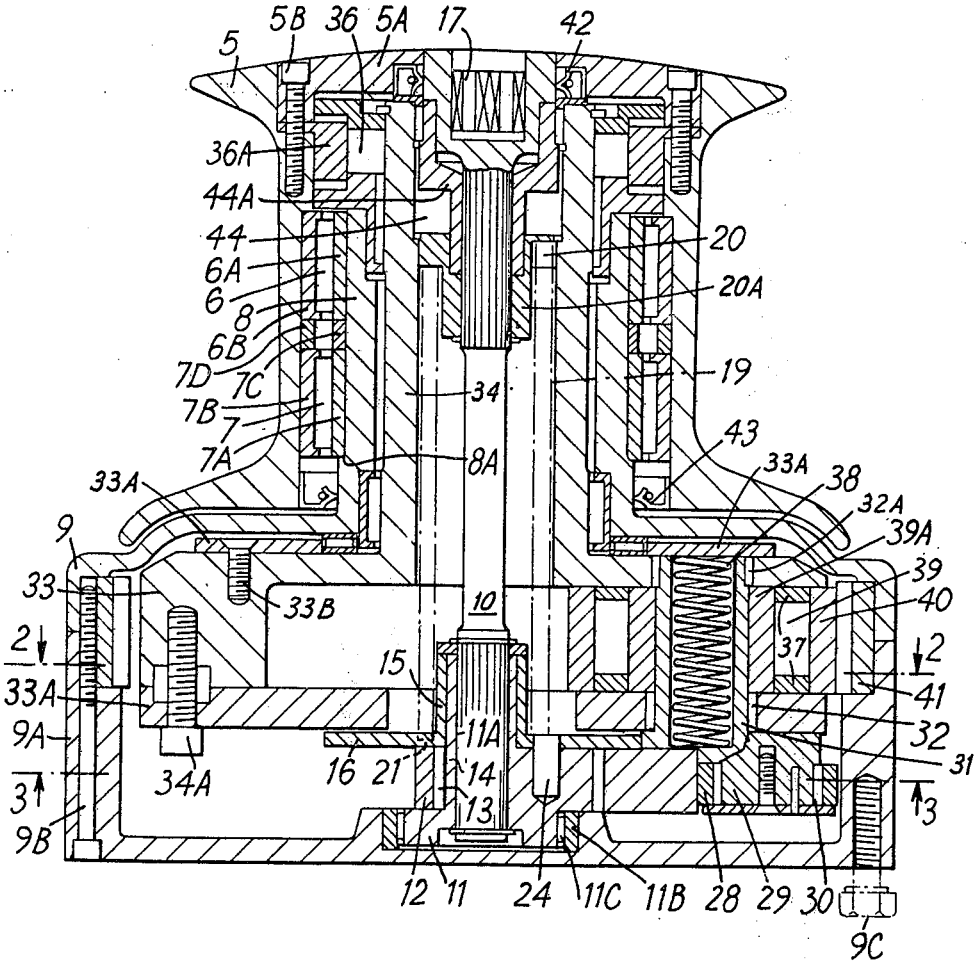
FIG. 1 is a vertical sectional view of a hand operated winch made in accordance with the invention.
Figure 2:
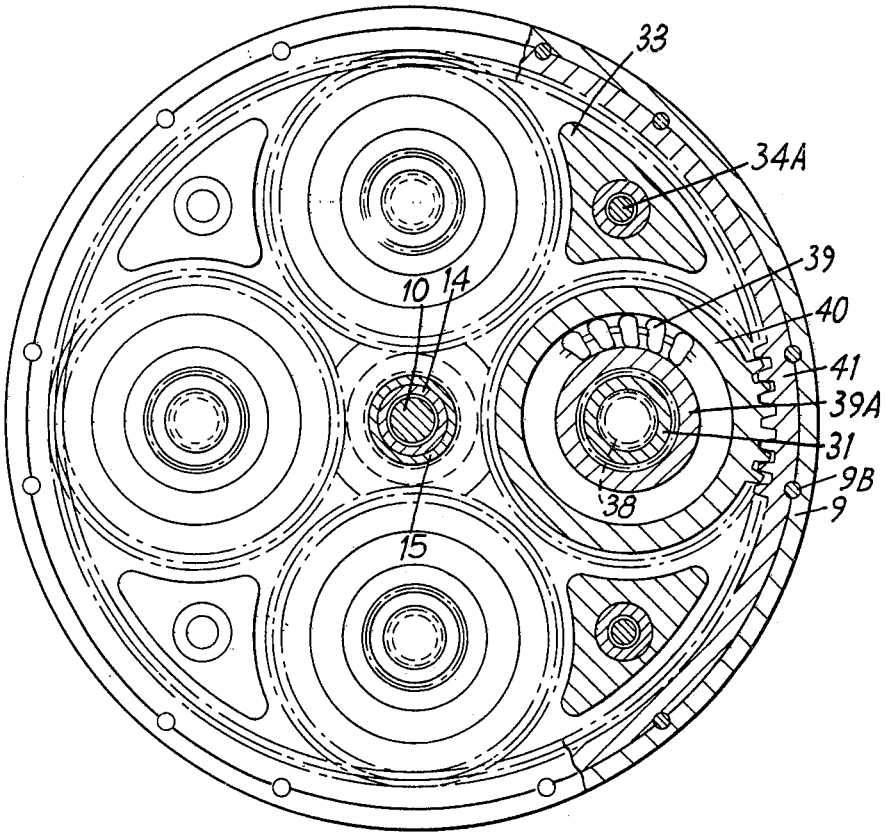
FIG. 2 is a part section and part plan on the plan 2—2 on FIG. 1.
Figure 3:
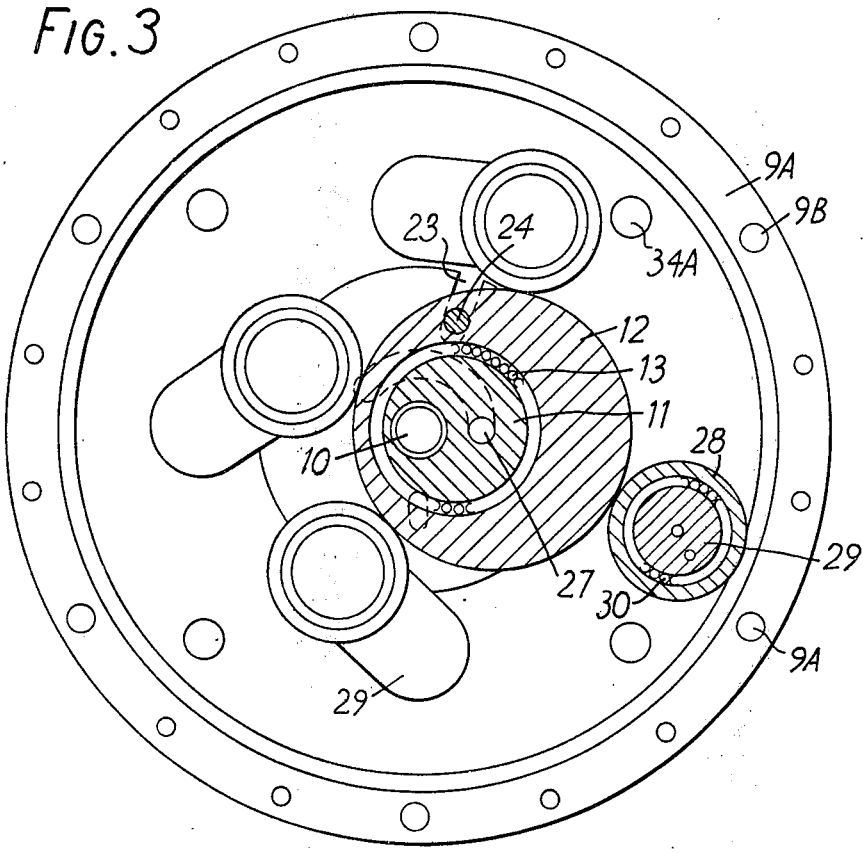
FIG. 3 is part section and part plan on the line 3—3 on FIG. 1.
Figure 4:
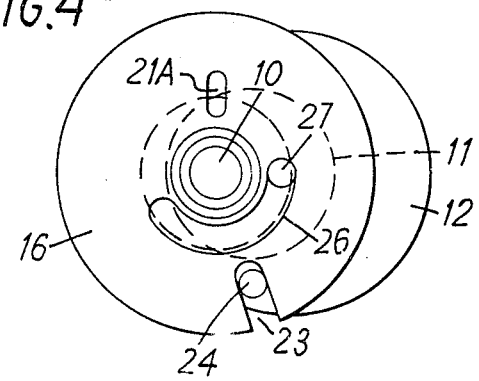
FIG. 4 is a plan view of some parts to be described.

The winch comprises a winch drum 5 which surrounds a tubular support 8 which is part of a housing 9. The housing 9 has a cap 9A attached to it by screws 9B. The housing can be fixed to a deck by bolts 9C. The drum is mounted on bearings 6, 7 carried by the tubular support 8. The inner races 6A, 7A of these bearings are fitted on to the member 8 and the outer races 6B, 7B are fitted into the drum 5. The races are spaced apart by rings 7C, 7D. The race 7A seats on a shoulder 8A on the member 8. The drum has a cover plate 5A attached by bolts 5B. A driving shaft 10 is splined at 17 to receive a stud on a handle. The shaft 10 carries an inner eccentric 11 on splines 11A and an outer eccentric 12 is mounted on 11 by means of needle bearings 13 so that the two eccentrics 11, 12 form a combined variable throw device. The inner eccentric is located in needle bearings 11C and bearing ring 11B. The inner eccentric 11 has a tubular extension 14 surrounded by a sleeve 15 that carries a disc 16 rotatably. A torsion spring 19 surrounds the shaft 10 and is fixed at its upper end 20 to a member 20A that is splined to the shaft and is fixed at its lower end at 21 by entry into a slot 21A (FIG. 4) in the disc 16. The disc 16 has a slot 23 engaged by a pin 24 that is carried by the outer eccentric 12, so that the disc 16 will rotate with the outer eccentric 12. The disc 16 has an arcuate slot 26 engaged by a stop pin 27 carried by the eccentric 11 which limits the relative movement of the eccentrics 11, 12. The spring 19 is wound up on assembly so that in the no-load position the pin 27 is at the end of the slot as shown and the eccentrics are offset to about the maximum extent from each other.

The outer eccentric 12 is engaged by four rollers 28. Each roller 28 is mounted on one end of a crank arm 29 by needle bearings 30. The other ends of the crank arms have sleeves 31 integral therewith and mounted by needle bearings 32A on a carrier 33 which has a tubular extension 34 which surrounds the spring 19 and is disposed within the support 8 and surrounds the shaft 10, and is drivably connected to the drum 5 by a unidirectional detent device comprising friction members 36 and a race 36A fixed to the drum. In an alternative construction the extension 34 is fixed to the drum. A cover plate 33A is attached to the carrier 33 by bolts 33B. Springs 38 act on the crank arms to hold the rollers 28 against the eccentric 12. The springs 38 are engaged at one end thereof in holes in the plate 38A. The other ends of the springs 38 are engaged in holes in the crank arms 29 respectively. The sleeves 31 carry strut type one way clutches having friction elements 39 and inner races 39A. The outer races are formed as planetary gears 40 which all mesh with a fixed reaction ring gear 41 attached to the housing 9. The races 39A are separated from the gears 40 by bearing rings 37. The clutches engage the gears in the drum driving direction. In a modified construction the ring gear is replaced by a sunwheel. In this case the sunwheel is driven and the carrier 33 is fixed to the housing and provides reaction. In a further modification the ring gear may be driven and the carrier fixed.

Seals 42 are provided between the drum and the drum shaft 10 and seals 43 are provided between the drum 5 and the support 8.

A unidirectional clutch having friction members 44 acts between a race 44A splined to the shaft 10 and the part 34 to prevent reversal of the winch.

In operation rotation of the shaft 10 at light loads rotates the inner eccentric 11 which acts through the pin 24 to rotate the disc 16. This in turn acts through the pin 27 to rotate the outer eccentric 12 so that under light load the two eccentrics rotate in unison at maximum throw. As the eccentrics rotate the outer eccentric 12 moves the rollers 28 successively out thus imparting rotary motion to the arms 29 and gears 40 which react on the fixed gear 41 to cause all parts 34, 31, 39, 40 to rotate about the shaft 10 thereby rotating the drum 5 through the clutch 36.

As the load increases on the drum 5 there is an increasing resistance to the rotation of the parts 34, 31, 39, 40 and thus an increasing force of the rollers 28 against the outer eccentric 12 tending to hold the latter against rotation. Thus the rollers 28 and their supporting means serve as restraining means tending to restrain the outer eccentric 12 from rotation. Accordingly the inner eccentric 11 rotates within the outer eccentric 12 and the spring 19 is wound up with increased tension which is applied by the shaft 10 to the outer eccentric 12. Increased force on the outer eccentric 12 due to increased resistance of the rollers 28 on the outer eccentric 12 will cause the eccentrics to rotate further relatively to each other thereby decreasing the combined throw of the eccentrics still further with correspondingly increased driving ratio of the winch and increasing the tension in and load exerted by the spring 19.

With decrease in load on the winch and resistance of the rollers 28, the spring 19 will rotate the outer eccentric 12 relatively to the inner eccentric in the opposite direction thereby increasing the combined throw and decreasing the driving ratio.

During each driving engagement of the one way clutches as the speeds and leverages are not uniform, the spring 19 can increase and decrease in load thereby producing more constant speeds and loads. At some given maximum load the pin 27 on the outer eccentric may come against the other end of the slot 26, the power ratio then remaining substantially non-variable.

The spring 19 may carry an initial load equivalent to the minimum driving load and provide the maximum displacement of the crank arms and the one way clutches will engage through the greatest angle thereby driving the planetary gears 40 at maximum speed.

I claim:

1. A load moving device comprising an input member (10), an inner eccentric (11) connected to the input member, an outer eccentric (12) surrounding the inner eccentric so that the two eccentrics combine to form a variable throw device, spring means (19) connected to the input member and to the outer eccentric and pretensioned to hold the eccentrics in about maximum throw position, contact elements (28) engaging the outer eccentric, a contact elements carrier (34) which serves as an output member, arms (29) pivotally carried by the carrier (34) and each carrying one of said contact elements, a reaction member (9), unidirectional clutches (39) connected with said arms respectively and gears (40) operatively connected between said clutches (39) and said reaction member (9).

2. A load moving device as claimed in claim 1 wherein the contact elements carrier (34) is mounted for rotation around the axis of the eccentrics and drivably connected (36) with the output member (5), said reaction gear (41) being fixed.

3. A load moving device as claimed in claim 1 wherein the output member is a winch drum (5) and comprising a tubular support (8) located within the drum and on which the drum is rotatably mounted, said support being carried by a housing (9); a tubular extension of the carrier (34) disposed within the support (8) and drivably connected and fixed to said drum; said input member being a driving shaft (10) located within the carrier (34); said spring means being a helical spring (19) surrounding the driving shaft and within the carrier (34); said spring (19) having its upper end fixed to the driving shaft, and its lower end fixed to a rotatable member (16); pin and slot means connecting the rotatable member with the outer eccentric; said rotatable member (16) having a concentric slot (26) engaged by a stop pin (27) carried by the inner eccentric; said reaction gear (41) being an internally toothed ring gear on the housing (9).

4. A load moving device as claimed in claim 1 wherein said contact elements are rollers (28) carried by sleeves (31) mounted in bearings in the carrier (34), each sleeve containing a spring which urges the crank arms and rollers against the outer eccentric (12), each sleeve being surrounded by a unidirectional clutch, the outer race of which is the gear (40) which meshes with the reaction gear (41).

5. A load moving device as claimed in claim 1 having a winch drum surrounding said carrier and in which said carrier (34) is mounted for rotation around the axis of the eccentrics and is drivably connected (36) with said drum.

6. A load moving device as claimed in claim 1 wherein said gears comprise a fixed internally toothed ring gear, and gearwheels meshed with said ring gear, said gearwheels forming the outer races of said clutches.

* * * * *